United States Patent [19]

Itazu

[11] Patent Number: 4,909,646

[45] Date of Patent: Mar. 20, 1990

[54] PRINTER HEAD IN WHICH A PRINTING END CAN BE READILY MACHINED WITHOUT BEING OBSTRUCTED BY A PROTECTING MEMBER THEREFOR

[75] Inventor: Kishiharu Itazu, Tokyo, Japan

[73] Assignee: NEC Corporation, Tokyo, Japan

[21] Appl. No.: 212,373

[22] Filed: Jun. 27, 1988

[30] Foreign Application Priority Data

Jun. 25, 1987 [JP] Japan ..... 62-158131

[51] Int. Cl.[4] ..... B41J 29/12; B41J 3/00

[52] U.S. Cl. ..... 400/124

[58] Field of Search ..... 400/124, 124 GT

[56] References Cited

U.S. PATENT DOCUMENTS 3,987,883 10/1976 Darwin et al. ..... 400/124

4,661,002 4/1987 Ara ..... 400/124

FOREIGN PATENT DOCUMENTS 0267716 5/1988 European Pat. Off. ..... 400/124

82050 4/1987 Japan ..... 400/124

*Primary Examiner*—Edgar S. Burr

*Assistant Examiner*—Kimberly L. Asher

*Attorney, Agent, or Firm*—Sughrue, Mion, Zinn, Macpeak & Seas

[57] ABSTRACT

In a printer head comprising a print element (12) and a protecting member (32) which is for protecting a printing end (24) of the print element, the protecting member is movable in a predetermined direction to place a free end (34) thereof at a first and a second position. The printing end is movable between a rest position and an activated or printing position in a first sense of the predetermined direction. When placed in the first position, the free end is substantially flush with the printing end put in the rest position so that the protecting member effectively protects the printing end. When the protecting member is moved in a second sense opposite to the first sense, the free end is retracted from the first position in the second sense to be placed at the second position so that the printing end can be readily machined without being obstructed by the protecting member. Preferably, the protecting member is rendered integral with a holding member (26) for holding the print element so that the printing end is movable between the rest position and the activated position.

7 Claims, 3 Drawing Sheets

PRINTER HEAD IN WHICH A PRINTING END CAN BE READILY MACHINED WITHOUT BEING OBSTRUCTED BY A PROTECTING MEMBER THEREFOR

BACKGROUND OF THE INVENTION

This invention relates to a printer head for use in a printer which is of the type generally called, for example, a dot impact printer or a dot character printer.

Such a conventional printer head comprises a frame member and a plurality of print elements. The frame member has a principal surface which opposes a print medium when the printer head is in use. Each of the print elements has a printing end which is for impacting the print medium to print a dot on the printing medium. In order to carry out such a print operation, the printing end is movable from a rest position to an activated position in a predetermined sense of a predetermined direction which is perpendicular to the principal surface.

In the conventional printer head, the printing end protrudes from the principal surface of the frame member in the predetermined sense even when it is placed at the rest position. For protecting such a protruded part of the printing end, the conventional printer head comprises a protecting member which is fixed to the frame member. The protecting member has a free end which is substantially flush with the printing end. Such a free end serves to effectively protect the printing end.

On manufacturing such a printer head, the print elements are movably carried by the frame member. Thereafter, the printing end is usually machined, as by grinding to adjust the rest position.

However, it is hard to carry out machining of the printing end in the conventional printer head because the free end obstructs the machining. As a result, the printing end is protruded from the free end in the predetermined sense to an extent of, for example, several tens of microns even when it is placed at the rest position. This results in troubles of the print operation because the free end of the protecting member does not serve to effectively protect the printing end.

SUMMARY OF THE INVENTION

It is therefore an object of the present invention to provide a printer head in which a printing end of a print element can be readily machined without being obstructed by a protecting member for the free end.

Other objects of this invention will become clear as the description proceeds.

According to this invention, there is provided a printer head comprising a frame member having a principal surface, a print element having a printing end movable from a rest position to an activated position in a first predetermined sense of a predetermined direction which is perpendicular to the principal surface, and holding means having a free end and coupled to the frame member for slidably holding the printing end. In the printer head, the holding means is movable in the predetermined direction to place said free end at a first and a second predetermined position, the first predetermined position being substantially flush with the printing end put in the rest position, the second predetermined position being retracted from the first predetermined position in a second predetermined sense opposite to the first predetermined sense.

DESCRIPTION OF THE PREFERRED EMBODIMENT

Figure 1:
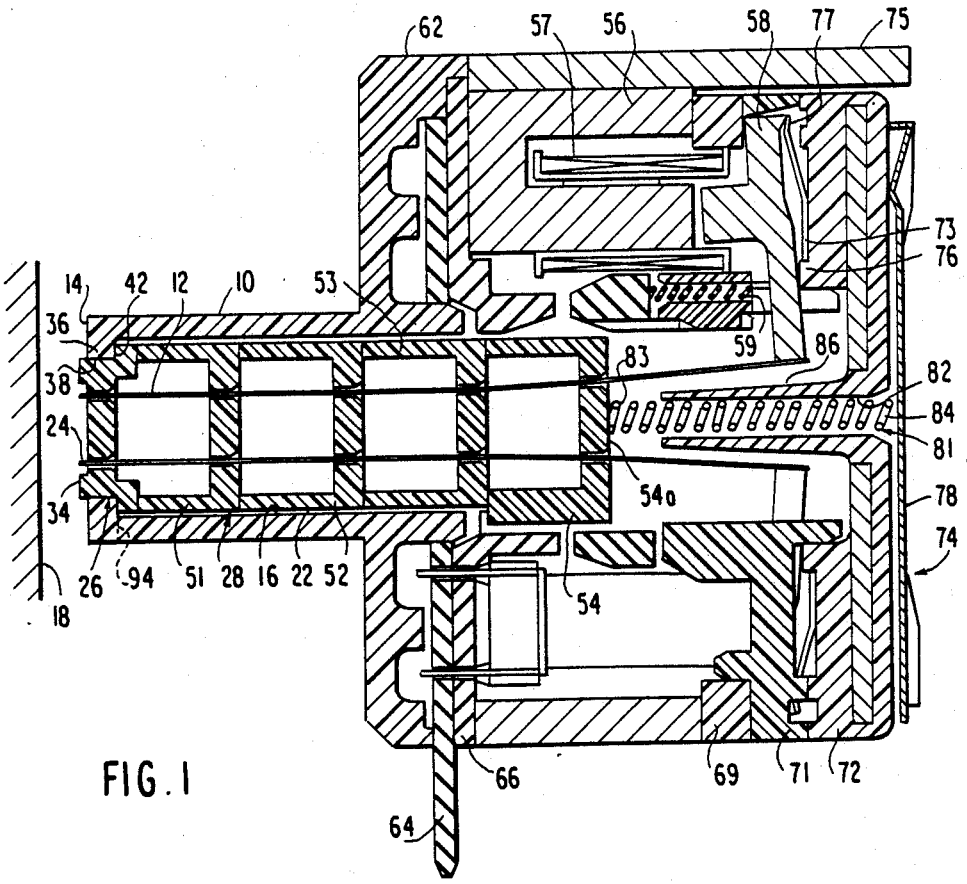
FIG. 1 shows, together with a printing medium, a longitudinal sectional view of a printer head according to an embodiment of this invention.
Figure 2:
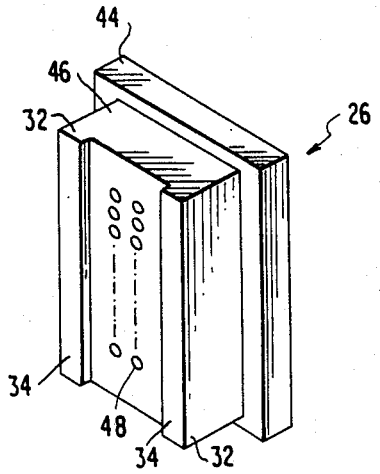
FIG. 2 is a perspective view of a holding member for use in the printer head shown in FIG. 1.

Referring to FIGS. 1 and 2, a printer head according to a preferred embodiment of this invention comprises a frame member 10 of a plastic material and a plurality of print elements 12 of high-speed steel. In the example being illustrated, the frame member 10 is substantially rectangle in cross-section. Each of the print elements 12 has a wire shape. The frame member 10 has a principal surface 14 and an inner side surface 16. The principal surface 14 is opposed to a printing medium 18 when the printer head is in use. The inner side surface 16 is for defining a hollow space 22 extended in a predetermined direction which is perpendicular to the principal surface 14. The print elements 12 are held in the hollow space 22 in the manner which will later be described in detail.

The print elements 12 are extended substantially parallel to the predetermined direction as will be described far later in the description. Each of the print elements 12 has a printing end 24 at one end depicted leftwardly of the figure. The printing end 24 is for impacting the printing medium 18 to print a dot on the printing medium 18. In order to carry out such a printing operation, each of the print elements 12 is movable along a longitudinal direction thereof in a first predetermined sense (namely, a left sense in FIG. 1) of the predetermined direction from a rest position to an activated position.

The printer head further comprises holding and guiding members 26 and 28 which are of a plastic material and which are placed in the hollow space 22 to be movable in the predetermined direction. The holding member 26 is for holding the print elements 12 near their printing ends 24 so that each printing end 24 is movable between the rest position and the activated position with the print elements 12 guided by the guiding member 28. The holding and the guiding members 26 and 28 will later be described in detail.

In the printer head, the printing end 24 protrudes from the principal surface 14 of the frame member 10 in the first predetermined sense even when it is placed at the rest position. For protecting such a protruded part of the printing end 24, the printer head comprises two protecting members 32 which are rendered integral with the holding member 26 as clearly shown in FIG. 2. The protecting members 32 have free ends 34 and are movable in the predetermined direction to place the free ends 34 at a first and a second predetermined position as will presently be described.

The frame member 10 includes a flange portion 36 which is radially inwardly protruded from the inner side surface 16 to define a rectangular opening 38. The flange portion 36 has an inside surface 42 which faces the hollow space 22 parallel to the principal surface 14.

In FIG. 2, the holding member 26 includes a body portion 44 and a protruded portion 46 which is protruded from the body portion 44 in the first predetermined sense. The body portion 44 is placed inwardly of the flange portion 36. The protruded poton 46 is rectangular in cross-section and is fitted in the rectangular opening 38 slidably in the predetermined direction. Therefore, the holding member 26 is movable in the predetermined direction until the body portion 44 comes into contact with the inside surface 42 of the flange portion 36.

In case where the body portion 44 is in contact with the inside surface 42, the free ends 34 are placed at the first predetermined position. When the holding member 26 is moved in a second predetermined sense which is opposite to the first predetermined sense, the free ends 34 are displaced to the second predetermined position.

In FIG. 2, the protecting members 32 extend vertically in the figure in parallel to the principal surface 14 with a predetermined distance left therebetween. A plurality of holding holes 48 are formed at azimuthal positions through the holding member 26 in the predetermined direction. The holding holes 48 are for slidably receiving the respective print elements 12 so that the printing end 24 is movable between the rest position and the activated position. The holding holes 48 are arranged between the protecting members 32 along two rows parallel to each of the protecting members 32.

Figure 3:
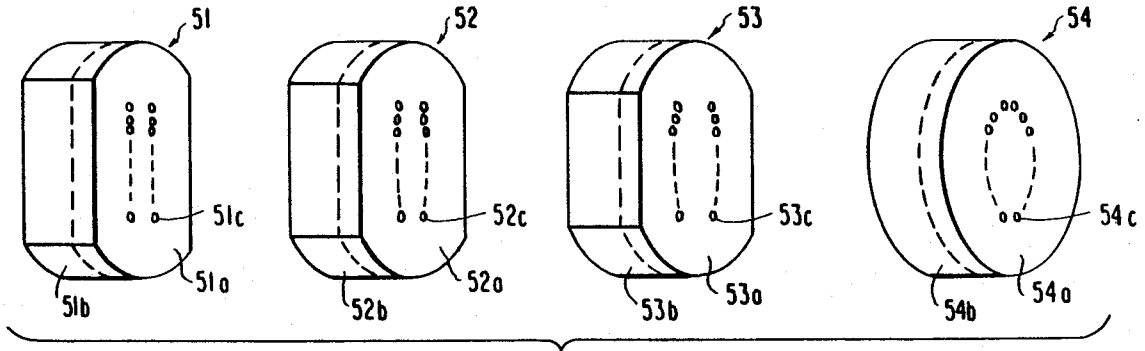
FIG. 3 is an exploded perspective view of a guiding member for use in the printer head shown in FIG. 1.
Figure 4:
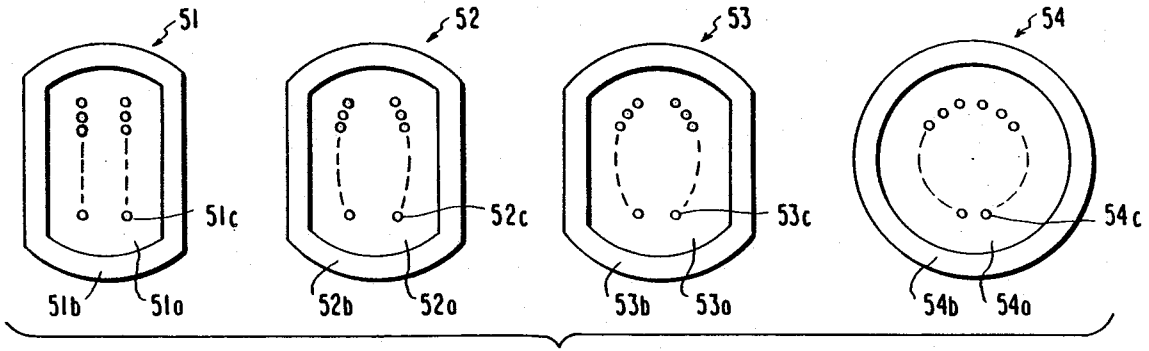
FIG. 4 shows front views of guiding elements used in the guiding member shown in FIG. 3.

Referring to FIGS. 3 and 4 together with FIG. 1, the guiding member 28 comprises first through fourth guiding elements 51 to 54 which are adjacent to one another in the predetermined direction.

The first guiding element 51 is of a cup shape and comprises a plate portion **51*a* and a pipe-shaped portion 51*b* which is rendered integral with the plate portion 51*a*. In FIG. 3, the cup shape has an opening directed leftwards. The plate portion 51*a* is parallel to the principal surface 14 and has a plurality of guiding holes 51*c* at azimuthal positions. The guiding holes 51*c* are for slidably receiving the respective print elements 12 and are formed through the plate portion 51*a* in the predetermined direction. The guiding holes 51*c* are arranged along a first predetermined form which will be clear from FIG. 4 and are for slidably receiving the respective print elements 12. The pipe-shaped portion 51*b* has an axial free end which is in contact with the holding member 26. As a result, the pipe-shaped portion 51*b* serves as a spacing member to space between the holding member 26 and the plate portion 51*a***.

Each of the second, the third, and the fourth guiding elements 52, 53, and 54 is similar to the first guiding element 51. Therefore, similar parts are designated by the reference numerals 52 to 54 with suffixes *a*, *b*, and *c* added.

The second through the fourth guiding elements 52 to 54 comprise plate portions **52*a* to 54*a* and pipe-shaped portions 51*b* to 54*b* which are rendered integral with the plate portions 52*a* to 54*b*, respectively. Each of the plate portions 52*a* to 54*a* is parallel to the principal surface 14 and has a plurality of guiding holes 52*c* to 54*c*. The guiding holes 52*c* to 54*c* are for slidably receiving the respective print elements 12, and are formed through the plate potions 52*a* to 54*a* in the predetermined direction. The guiding hole 52*c* of the second guiding element 52 is arranged along a second predetermined form which will be clear from FIG. 4. The guiding hole 53*c* of the third guiding element 53 is arranged along a third predetermined form which will be clear from FIG. 4. The guiding hole 54*c* of the fourth guiding element 54 is arranged along a fourth predetermined form which will be clear from FIG. 4. The pipe-shaped portions 52*b* to 54*b* have axial free ends which are in contact with the first through the third guiding elements 51 to 53** to serve as spacing members, respectively.

Description will be directed to the manner in which the print elements 12 extend substantially parallel to the predetermined direction. The two-row arrangement of the holding holes 48 will be called a zeroth predetermined form. The zeroth through the fourth predetermined forms are different from one another as will be understood from FIGS. 2 through 4. Each of the print elements 12 has a longitudinal axis which is slightly deformed depending on the azimuthal positions of the holding and the guiding holes 48 and **51*c* through 54*c*. With the arrangement, each of the print elements 12** becomes substantially parallel to the predetermined direction.

In FIGS. 2 through 4, only a few holding and guiding holes 48, **51*c*, 52*c*, 53*c*, and 54*c* are depicted for simplification of illustration. In practice, each of the holding and the guiding holes 48, 51*c*, 52*c*, 53*c*, and 54*c*** is, for example, either twenty-four or forty-eight in number.

In FIG. 1, the printer head comprises a plurality of driving units for driving the print elements 12 in the predetermined direction. The driving units are circularly arranged around a center axis of the hollow space 22. Each of the driving units comprises a yoke member 56, a coil member 57, an armature 58, and a return spring 59 and serves to move each of the print elements 12 by driving the armature 58 in the manner known in the art.

The printer head further comprises a radial wall 62, a circuit board 64, and an insulating board 66. The radial wall 62 is radially outwardly extended from the frame member 10. The circuit board 64 is opposite to the wall portion and has an electric circuit for collectively controlling operation of the driving units. The insulating board 66 is placed between the yoke member 56 and the circuit board 64 and is for electrically insulating the yoke member 56 from the circuit board 64.

Figure 5:
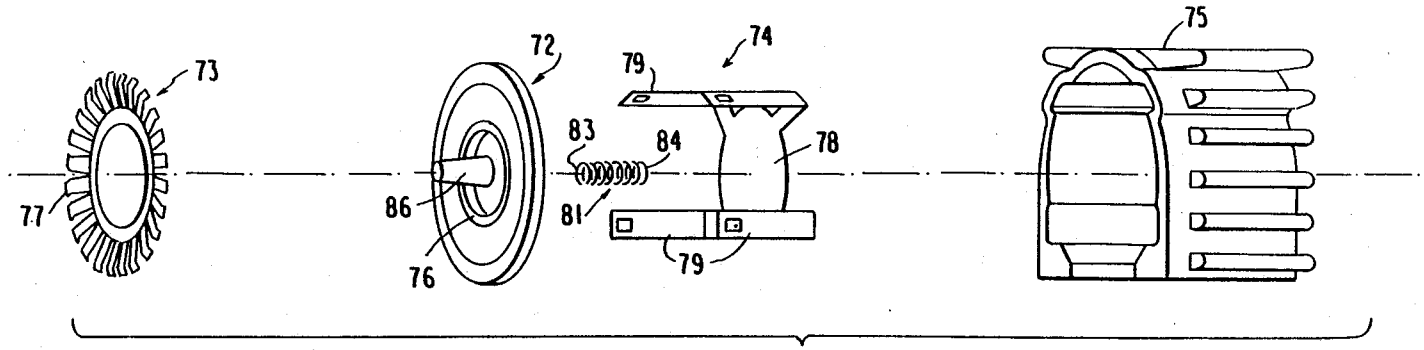
FIG. 5 is an exploded perspective view of a stopper plate, a spring washer, a cover spring, a heat sink, and a coil spring for use in the printer head shown in FIG. 1.

Referring to FIG. 5 together with FIGS. 1 and 2, the printer head comprises a ring member 69, an armature support 71, a stopper plate 72, a spring washer 73, a cover spring 74, and a heat sink 75. The armature support 71 is of a ring shape and is for supporting the armature 58 through the ring member 69 in the predetermined direction. The stopper plate 72 is superposed on the armature support 71 in the predetermined direction and has a ring-shaped receiving portion 76 for receiving the armature 58. The spring washer 73 is placed between the armature support 71 and the stopper plate 72 and has a plurality of leaf spring protrusions 77. Each of the leaf spring protrusions 77 is in press contact with the armature 58 against the return spring 59. The cover spring 74 comprises a cover plate 78 having a peripheral edge portion and four leaf spring portions 79 which are extended from the peripheral edge portion in the first predetermined sense. Each of the leaf spring portions 79 engages with the radial wall 62. As a result, the cover spring 74 serves to hold a combination of the driving units, the armature support 71, the stopper plate 72, and the spring washer 73. The heat sink 75 is provided to cover the combination and is for facilitating a heat radiation of the combination.

The printer head further comprises a coil spring 81 extending in the predetermined direction through a through hole 82 which is defined by the stopper plate 72. The coil spring 81 has a movable end 83 and a fixed end 84 which is in press contact with the cover plate 78 of the cover spring 74. The movable end 83 is in press contact with the plate portion 54*a* of the fourth guiding element 54. As a result, the coil spring 81 serves to urge the holding member 26 to the inside surface 42 of the flange portion 36 through the guiding member 28. A combination of the guiding member 28 and the coil spring 81 may therefore be referred to as an urging arrangement. For making the movable end 83 smoothly move in the predetermined direction, the stopper plate 72 includes a spring guide 86 which partially surrounds the coil spring 81.

Figure 7:
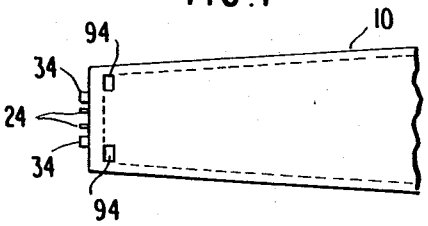
FIG. 7 is a bottom view of a part of the printer head shown in FIG. 1.
Figure 6:
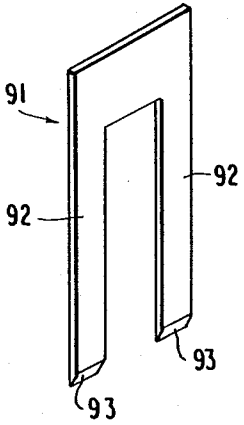
FIG. 6 is a perspective view of an operating plate which is for moving the holding member shown in FIG. 2.

Referring to FIGS. 6 and 7 together with FIG. 1, it is preferable to use an operating plate 91 for making the holding member 26 move in the second predetermined sense to place the free ends 34 at the second predetermined position. The operating plate 91 has two leg portions 92 which are parallel to one another. Each of the leg portions 92 has a wedge shaped portion 93 at one end thereof.

The frame member 10 has two operating holes 94 which are for receiving the leg portions 92, respectively. Each of operating holes 94 has a hole axis which is substantially coplanar with the inside surface 42.

Referring to FIGS. 1, 2, 6, and 7, description will be made as regards a case where it is desired to move the free ends 34 to the second predetermined position. The wedge shaped portions 93 are inserted through the respective operating holes 94 into an interface between the inside surface 42 and the body portion 44 of the holding member 26. When the wedge shaped portion 93 are so inserted, the holding member 26 is moved in the second predetermined sense together with the guiding member 28 to compress the coil spring 81. Subsequently, the leg portions 92 are placed between the inside surface 42 and the body portion 44. As a result, the free ends 34 are placed at the second predetermined position.

In this state, each of the printing ends 32 can be readily machined without being obstructed by the protecting members 32. This is because the free ends 34 are displaced from the printing ends 32 in the second predetermined sense.

When the operating plate 91 is removed from the frame member 10, the holding and the guiding members 26 and 28 are moved in the first predetermined sense by the coil spring 81. In this state, it is a matter of course that the printing ends 32 are effectively protected by the free ends 32.

While the present invention has thus far been described in connection with only one embodiment thereof, it will readily be possible for those skilled in the art to put this invention into practice in various other manners. For example, the guiding element may be less than four in number or more than four. After the free ends are placed at the second predetermined position to produce a predetermined gap between the inside surface and the body portion of the holding member, the operating plate may be inserted into the predetermined gap.

What is claimed is:

1. In a printer head comprising a frame member having a principal surface, a print element having a printing end movable from a rest position to an activated position in a predetermined direction perpendicular to said principal surface, and protecting means having a free end and coupled to said frame member for protecting said printing end, the improvement wherein said protecting means is movable in said predetermined direction to place said free end at a first and a second predetermined position, said first predetermined position being substantially flush with the printing end put in said rest position, said second predetermined position being retracted from said first predetermined position in a direction opposite to said predetermined direction.

2. A printer head as claimed in claim 1, further comprising holding means for slidably holding said print element so that said printing end is movable between said rest position and said activated position, said holding means being integral with said protecting means and being movable selectively between said first and said second predetermined positions.

3. A printer head as claimed in claim 2, said frame member having an inside surface which is parallel to said principal surface, said printer head further comprising urging means urging said holding means against said inside surface in said first predetermined position.

4. A printer head as claimed in claim 3, wherein said frame member comprises wall portions which define a hole having a hole axis substantially coplanar with said inside surface, said hole being for use in putting a wedge shaped member therethrough into an interface between said inside surface and said holding means when it is desired to move said free end to said second predetermined position.

5. A printer head as claimed in claim 3, wherein said urging means comprises a coil spring having a movable end and a fixed end fixed relative to said frame member and guiding means for guiding said print element movable between said rest position and said activated position, said movable end of said coil spring urging said guiding means and said guiding means urging said holding means against said inside surface.

6. A printer head as claimed in claim 5, wherein said guiding means comprises:

a plurality of plate members parallel to said principal surface;

a spacing member between said holding means and one of said plate members; and an additional spacing member between two adjacent ones of said plate member.

7. A printer head as claimed in claim 5, wherein said guiding means comprises:

a plate member parallel to said principal surface; and a spacing member between said holding member and said plate member.

* * * * *

UNITED STATES PATENT AND TRADEMARK OFFICE

CERTIFICATE OF CORRECTION

PATENT NO. : 4,909,646

DATED : March 20, 1990

INVENTOR(S) : Kishiharu ITAZU

It is certified that error appears in the above-identified patent and that said Letters Patent is hereby corrected as shown below:

Col. 3, line 10, delete "poton" and insert --portion--;

line 68, delete "potions" and insert --portions--

Signed and Sealed this

Fifth Day of May, 1992

*Attest:*

DOUGLAS B. COMER

*Attesting Officer*

*Acting Commissioner of Patents and Trademarks*